US012678681B2

(12) United States Patent
Malm

(10) Patent No.: US 12,678,681 B2
(45) Date of Patent: Jul. 14, 2026

(54) EXERCISE EQUIPMENT CAPABLE OF DISPLAYING ILLUMINATED SIGNALS FOR IDENTIFYING USAGE STATUS

(71) Applicant: Johnson Health Tech. Co., Ltd., Taichung City (TW)

(72) Inventor: Chad Malm, Monona, WI (US)

(73) Assignee: Johnson Health Tech Co., Ltd., Taichung City (TW)

( * ) Notice: Subject to any disclaimer, the term of this patent is extended or adjusted under 35 U.S.C. 154(b) by 46 days.

(21) Appl. No.: 18/823,657

(22) Filed: Sep. 3, 2024

(65) Prior Publication Data

US 2025/0099837 A1 Mar. 27, 2025

(30) Foreign Application Priority Data

Sep. 22, 2023 (CN) ..... 202322579363.2

(51) Int. Cl.
*A63B 71/06* (2006.01)
*A63B 22/02* (2006.01)
*A63B 24/00* (2006.01)

(52) U.S. Cl.
CPC ..... *A63B 71/0622* (2013.01); *A63B 22/025* (2015.10); *A63B 24/0062* (2013.01); *A63B 24/0087* (2013.01); *A63B 2220/30* (2013.01); *A63B 2220/833* (2013.01); *A63B 2225/74* (2020.08)

(58) Field of Classification Search
CPC ..... A63B 71/0622; A63B 22/025; A63B 24/0062; A63B 24/0087; A63B 2220/30; A63B 2220/833; A63B 2225/74; A63B 2071/0658; A63B 22/0242; A63B 2071/0625; A63B 2071/065; A63B 2071/0694; A63B 2225/50; A63B 22/02
See application file for complete search history.

(56) References Cited

U.S. PATENT DOCUMENTS 5,368,532 A * 11/1994 Farnet ..... A63B 22/02 482/54
6,626,803 B1 * 9/2003 Oglesby ..... A63B 22/0242 482/54
6,682,461 B2 * 1/2004 Wang ..... A63B 22/02 482/54

(Continued)

FOREIGN PATENT DOCUMENTS

CN 102188790 B 7/2013

*Primary Examiner* — Garrett K Atkinson

(57) ABSTRACT

An exercise equipment comprises a frame assembly, a motion mechanism for a specific exercise by a user and a control unit monitoring the operational status of the motion mechanism. The frame assembly includes a left and a right side portion positioned respectively on the user's left and right sides. The inner side surfaces of the left and right side portions are equipped with a left and a right light-emitting portion. When the motion mechanism is in a first state, both those light-emitting portions display a first light-emitting state. When the motion mechanism is in a second state, both those light-emitting portions display a second light-emitting state. Therefore, people located on the right and left of the exercise equipment can respectively observe the left and right light-emitting portions and identify whether the motion mechanism is in the first or second state based on their light-emitting states.

19 Claims, 5 Drawing Sheets

(56) References Cited

U.S. PATENT DOCUMENTS

| | | | | |
|---|---|---|---|---|
| 9,430,920 | B2 * | 8/2016 | Munro | G08B 21/187 |
| 10,816,177 | B1 * | 10/2020 | Bayerlein | A63B 71/0622 |
| 10,912,984 | B2 * | 2/2021 | Liao | A63B 71/0054 |
| 2005/0039541 | A1 * | 2/2005 | Kurono | A61B 5/1038 73/800 |
| 2006/0035757 | A1 * | 2/2006 | Flick | A63B 22/0235 482/54 |
| 2008/0001772 | A1 * | 1/2008 | Saito | B65G 39/16 340/679 |
| 2008/0015088 | A1 | 1/2008 | Del Monaco | |
| 2009/0176629 | A1 * | 7/2009 | Yi | A63B 22/025 482/54 |
| 2009/0246746 | A1 * | 10/2009 | Roerdink | A61H 3/00 434/255 |
| 2016/0213976 | A1 * | 7/2016 | So | A63B 71/0622 |
| 2017/0136289 | A1 * | 5/2017 | Frank | A63B 21/4035 |
| 2017/0333747 | A1 * | 11/2017 | Athey | A63B 22/0228 |
| 2018/0140903 | A1 * | 5/2018 | Poure | A63B 71/0622 |
| 2020/0129837 | A1 * | 4/2020 | Liao | A63B 24/0087 |
| 2020/0332990 | A1 * | 10/2020 | Bayerlein | A63B 71/0686 |
| 2021/0041092 | A1 * | 2/2021 | Bayerlein | A63B 21/4035 |
| 2021/0394013 | A1 * | 12/2021 | Fima | A63B 22/0285 |

* cited by examiner

EXERCISE EQUIPMENT CAPABLE OF DISPLAYING ILLUMINATED SIGNALS FOR IDENTIFYING USAGE STATUS

FIELD OF THE INVENTION

The present invention relates to an exercise equipment. Specifically, it pertains to exercise equipment capable of displaying illuminated signals for users to identify its usage status.

DESCRIPTION OF THE RELATED ART

The US patent application publication number US 2008/0015088 A1 discloses an exercise equipment that displays various information at a specific location other than dashboard (console) for users to view. It employs light-emitting components such as LEDs or bulbs in these locations to show illuminated signals that allow users to identify its usage status, such as using a red light to indicate the equipment is in use, a yellow light to indicate that the equipment is currently in use but is nearing the final stage of the exercise session, and a green light to indicate that the equipment currently not in use. Alternatively, the number of illuminated bulbs in a row may gradually decrease over the elapsed time of the currently exercise session, displaying a rough indication of the usage progress. This system is particularly useful in places like fitness clubs or community sport centers with multiple pieces of exercise equipment available for communal use. By utilizing the illuminated signals to display each equipment's usage status, people seeking to exercise can quickly identify which equipment is currently available or soon to be available, thereby avoiding repeated searches and waiting without purpose.

As shown in FIGS. 7 to 10 of the abovementioned case. When the illuminated signal function is applied to the treadmill, it may involve placing a light-emitting component (such as LEDs capable of changing their emission color base on control signals) at the rear ends of the left and right handles of the treadmill or at the rear ends of the base on the left and right sides. Alternatively, multiple light-emitting components (such as bulbs capable of independently lighting up or turning off base on control signals) may be arranged along the left and right sides of the base in the longitudinal direction. This allows the illuminated signals to be displayed to people behind and on the left and right sides of the treadmill.

However, in places where the illuminated signal function is most needed, such as fitness clubs or community sports centers, and based on space utilization and convenience, the same type of exercise equipment (especially treadmills, spinning bike, and elliptical trainers) are typically arranged in continuous rows with the same orientation and adjacent to each other. Additionally, a walkway is usually left behind each row of exercise equipment, extending along the direction of the row. For example, in large fitness clubs, it is common to see a dozen or more treadmills of the same specifications neatly lined up in a single row. The spacing between adjacent treadmills is generally less than the width of one treadmill (usually not exceeding half of the width, and in more compact arrangements, it may be as narrow as 20 cm), while the walkway behind the treadmills is relatively spacious (e.g., the walkway width can be as wide as the length of one treadmill). People can walk along the walkway behind the treadmills, moving between the treadmill at the leftmost end and the treadmill at rightmost end, and they usually step onto an unused treadmill from behind along the walkway, as well as leave along the walkway after stepping off the treadmill. In such usage environments, when almost all the treadmills in a row are in use, someone standing on the walkway behind these treadmills, wanting to check the illuminated signals to confirm if any treadmill is about to become available, may still have difficulty seeing or clearly identifying the illuminated signals on treadmills that are farther away (e.g., beyond four or five treadmills), even if the person has normal height and vision. As a result, they still need to walk nearly the entire length of the walkway, which means passing or approaching the back or side of each treadmill, in order to visually confirm the illuminated signals on all the treadmills one by one.

The reason why one must approach each treadmill closely to see its illuminated signals clearly is not due to issues like the brightness of the illuminated signals, but rather the visibility angle of where the illuminated signals are located. In the above-mentioned usage environment, when an observer on the walkway behind a row of treadmills attempts to observe treadmills that are farther away, if the illuminated signals are displayed on the left and right sides of the base near the ground, these sides facing the observer are often obscured by the bases of adjacent treadmills that are closer. The farther away the treadmills are, the more obscured they will be. Therefore, the observer must approach to a certain extent to see the illuminated signals displayed on the sides of the bases. If the illuminated signals are displayed in other locations on the left and right sides of the treadmills, such as on the left and right uprights of the frame or on the outer side surfaces of the left and right handles, the situation is similar. For instance, when observing from the left end of the walkway towards the right, the left uprights and outer side surfaces (i.e. the left sides) of treadmills farther away are mostly be obscured by the right uprights and handles of adjacent treadmill aligned to their left. In addition, if the illuminated signals are displayed at the rear ends of the left and right handles or at the rear ends of the left and right sides of the base, because these areas are inherently small and face towards the rear of the treadmill, they appear narrower when observed from the sides. Therefore, illuminated signals displayed in these locations are typically best viewed from behind the treadmill.

Furthermore, the aforementioned illuminated signals in prior art only display the usage status of exercise equipment to people outside the equipment (especially behind and on the left and right sides). However, the current users of the exercise equipment themselves are unable to see these illuminated signals indicating occupancy, thereby limiting their practical effectiveness.

On the other hand, when a user stops exercising on a piece of exercise equipment, people waiting to take over from outside the exercise equipment find it difficult to discern whether the user intends to continue using (for example, if the user has paused the exercise), or is preparing to finish (for example, if the user has stopped the exercise by pressing the stop button). As a result, they cannot accurately determine whether they should look for another machine or wait for a while.

SUMMARY OF THE INVENTION

The purpose of the present invention is to provide a type of exercise equipment that displays illuminated signals for users to identify its usage status. Moreover, even in densely packed environments such as fitness clubs, where similar types of exercise equipment are typically arranged side by side, these illuminated signals can be easily seen from various angles and over a considerable distance.

Another purpose of the present invention is to provide a type of exercise equipment that displays illuminated signals for users to identify its usage status. Moreover, these illuminated signals are visible not only to individuals outside the exercise equipment, but also to the users currently using the equipment, enhancing feedback and safety of usage.

Another purpose of the present invention is to provide a type of exercise equipment, when a user stops exercising on the exercise equipment, individuals waiting to take over from outside the equipment can discern whether the user intends to continue using or is preparing to finish, aiding in the decision of whether to find another machine or wait for a while.

In order to achieve the above objectives, the present invention provides an exercise equipment comprising a frame assembly, a motion mechanism for a specific exercise by a user, and a control unit monitoring the operational status of the motion mechanism. The frame assembly includes a left side portion and a right side portion. The left side portion has an inner side surface facing towards the right side portion, and the right side portion having an inner side surface facing towards the left side portion. The inner side surface of the left side portion and the inner side surface of the right side portion are respectively equipped with a left light-emitting portion and a right light-emitting portion, each light-emitting portion is capable of emitting visible light through at least one light-emitting component.

The motion mechanism movably mounted on the frame assembly for a user to perform a specific exercise, wherein the left side portion and the right side portion are respectively located on the left side and the right side of the user performing the specific exercise, which makes them suitable for gripping by the user.

The control unit capable of monitoring the operational status of the motion mechanism, and electrically connected to light-emitting component.

Wherein the control unit is operable to control the light-emitting component based on the operational status of the motion mechanism. Specifically, when the motion mechanism is in a first state, both the left light-emitting portion and the right light-emitting portion display a first light-emitting state. Conversely, when the motion mechanism switches to a second state, both the left light-emitting portion and the right light-emitting portion display a second light-emitting state.

Preferably, the left light-emitting portion and the right light-emitting portion each has a rear end and a front end, and a length from the rear end to the front end is greater than 30 cm.

Preferably, the rear end of the left light-emitting portion is adjacent to a rear edge of the inner side surface of the left side portion, and the rear end of the right light-emitting portion is adjacent to a rear edge of the inner side surface of the right side portion.

Preferably, a top edge of the left light-emitting portion is located in an upper half of the inner side surface of the left side portion, and a top edge of the right light-emitting portion is located in an upper half of the inner side surface of the right side portion.

Preferably, the exercise equipment defines a body reference position within a movement space for the user to perform the specific exercise, and the front ends of the left light-emitting portion and the right light-emitting portion are both located ahead of the body reference position.

Preferably, the exercise equipment is a treadmill, the motion mechanism comprising a treadmill belt operable for continuous rotation, wherein the front ends of the left light-emitting portion and the right light-emitting portion are both located at least 15 cm ahead of a middle position between the front and rear ends of the treadmill belt.

Preferably, the exercise equipment includes a detection device electrically connected to the control unit, the detection device configured to detect a movement speed of a specific component connected to the motion mechanism; and wherein the control unit determines whether the motion mechanism is in the first state or the second state based on the movement speed.

Preferably, the exercise equipment includes an input device electrically connected to the control unit, the input device allowing the user to specify a predetermined time length for performing the specific exercise and enabling the user to instruct the exercise equipment to the start of the specific exercise; the control unit determines whether the motion mechanism is in the first state or the second state based on an elapsed time after receiving an indication to start the specific exercise from the input device.

Preferably, the exercise equipment includes an input device electrically connected to the control unit, the input device allowing the user to specify a predetermined time length for performing the specific exercise and enabling the user to instruct the exercise equipment to pause or stop of the specific exercise during the performance of the specific exercise; and wherein the control unit determines that the motion mechanism is in the first state when the input device receives an instruction to pause the specific exercise; and the control unit determines that the motion mechanism is in the second state when the input device receives an instruction to stop the specific exercise.

Preferably, the difference between the first light-emitting state and the second light-emitting state are characterized by variations in light-emitting color.

Preferably, the difference between the first light-emitting state and the second light-emitting state is characterized by variations in brightness.

Preferably, the difference between the first light-emitting state and the second light-emitting state is characterized by variations in illuminated area.

Preferably, the difference between the first light-emitting state and the second light-emitting state is characterized by variations in one emitting continuously while the other remains non-emissive.

Preferably, the difference between the first light-emitting state and the second light-emitting state is characterized by variations in one emitting continuously while the other emits intermittently.

Preferably, the difference between the first light-emitting state and the second light-emitting state is characterized by variations in one remaining non-emissive while the other emits intermittently.

Preferably, the difference between the first light-emitting state and the second light-emitting state is characterized by both emitting intermittently but with different on-off frequencies.

Preferably, the exercise equipment is an elliptical trainer, with the motion mechanism comprising a pedal operable to form a cyclical movement trajectory.

Preferably, the rear ends of the left light-emitting portion and the right light-emitting portion each form a semicircle with a forward-facing opening, extending forward in parallel from upper and lower ends of the semicircle.

Preferably, the left light-emitting portion and the right light-emitting portion each comprise two parallel lines and two semicircles, with the front ends of these parallel lines connected by one semicircle, and the rear ends of these parallel lines connected by the other semicircle.

Based on the aforementioned technical solution, the exercise equipment of the present invention can display illuminated signals through the left and right light-emitting portion to identify its usage status. This allowing individuals positioned to the right (including the rear right) and left (including the rear left) of the exercise equipment to respectively observe the left and right light-emitting portions. They can determine the operational status of the motion mechanism based on their light-emitting states. In densely packed environments such as fitness clubs, where similar types of exercise equipment are often arranged side by side, the left and right sides of each piece of equipment are respectively positioned to the left and right sides of the user. There is sufficient distance between their inner side surfaces (e.g., ranging from 50 to 60 cm, and even from 70 to 80 cm), which is typically greater than the distance between adjacent equipment. This arrangement allows individuals to easily see one of the light-emitting portions located on the inner side surface from both the left and right sides of the equipment. This wide viewing angle, which provides a relatively broad range of visibility, enables people to observe the illuminated signals from various angles and even from a considerable distance away.

Furthermore, when each light-emitting portion meets the conditions regarding shape, size, and/or position, users currently using the equipment who are positioned between the left and right sides of the exercise equipment are able view the illuminated signals, thereby enhancing the feedback and safety of usage.

Additionally, if each light-emitting portion displays different light-emitting states when the user instructs the exercise equipment to pause or stop the specific exercise, external individuals can discern whether the user intends to continue or is preparing to finish. This aids in deciding whether to find another machine or wait for a while.

DETAILED DESCRIPTION

The exercise equipment applicable to the present invention includes but is not limited to treadmills, elliptical trainer, stair climber, and stepper. Although the invention is particularly suitable for commercial-grade exercise equipment, it may also be applied to home-grade exercise equipment. The terms "commercial-grade" and "residential-grade" are relative concepts without a clear boundary between them. Generally, commercial-grade exercise equipment is characterized by higher specifications, larger size, and durability, intended for purchase and use in places such as fitness clubs. In contrast, residential-grade exercise equipment is relatively basic, smaller in size, and suitable for use in typical households.

Figure 1:
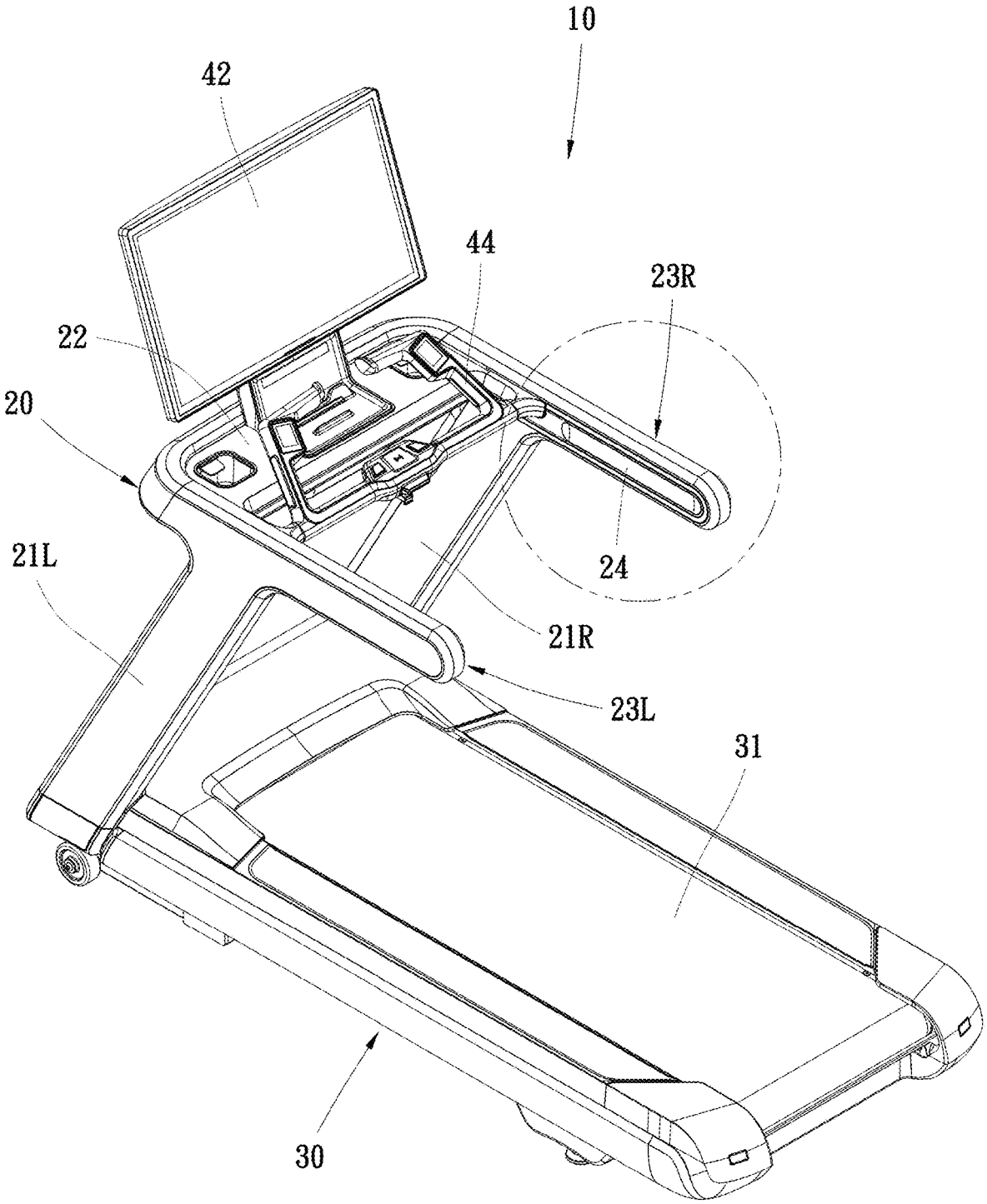
FIG. 1 is a perspective view of an exercise equipment (treadmill) in accordance with a first preferred embodiment of the present invention.

Referring to FIG. 1, which illustrates an exercise equipment in a first preferred embodiment of the present invention. The exercise equipment is specifically a treadmill 10. The treadmill 10 comprises a frame assembly 20, which has a treadmill deck 30 at its bottom. The deck 30 is equipped with a treadmill belt 31, operable for continuous rotation and driven by a motor, allowing a user to engage in a specific exercise such as walking, jogging, or running in place (hereinafter referred to as running exercise). The deck 30 can also be motor-driven to raise or lower its front end, thereby changing its angle relative to the ground (incline). The detailed structure and drive control of the deck 30 are not substantially related to the present invention and are not further described here. Other types of treadmills (such as Crawler-type or Passive-type) also do not affect the implementation of the present invention.

The frame assembly 20 comprises a left upright 21L and a right upright 21R, which are symmetrical. The left upright 21L and the right upright 21R extend upward from the left and right sides of the front end of the deck 30, respectively. A desk 22 is connected between the top ends of the left upright 21L and the right upright 21R. The desk 22 is equipped with a touch screen 42 that can not only displays various information for the user but also functions as an input interface. For example, the user can select exercise programs, set operational parameters such as speed, incline, and duration, and instruct the exercise equipment to start, pause, or stop exercise through the options displayed on the touch screen. Additionally, a handlebar assembly 44 for the user to grasp forward is provided between the top ends of the left upright 21L and the right upright 21R. In this embodiment, the handlebar assembly 44 includes physical buttons and a small touch screen for the user to input commonly used commands (such as increasing or decreasing speed, adjusting incline, starting exercise, pausing exercise, stopping exercise, and so on).

The treadmill 10 includes a control unit (not shown in the figure), which may be a microprocessor with specific programming or a control circuit assembly utilizing the microprocessor as its core. This control unit is typically located inside a console (the touch screen 42 in this embodiment) and is electrically connected to other circuits or electronic devices of the treadmill 10 via wired or wireless means. It offers comprehensive control over various aspects of the treadmill 10's operations and information, such as controlling the output content of output devices like the touch screen 42 and speakers, responding to user commands input through input devices such as the touch screen 42 and buttons, and managing the operation of a motion mechanism of the treadmill 10. This includes controlling the motor drive circuit to adjust speed of the belt 31, raising or lowering the front end of the deck 30, and monitoring signals from the motor drive circuit or sensors to determine the current speed of the belt 31 and the current incline of the deck 30.

The frame assembly 20 includes a left handrail 23L and a right handrail 23R, which are symmetrical. The left handrail 23L and the right handrail 23R respectively extend rearward from the top ends of the left upright 21L and the right upright 21R, positioned on the left and right sides of the user engaging in running exercise, and positioned at a height approximately corresponding to the waist level of an average person standing on the deck 30, allowing the user to hold on when necessary. From the perspective of this invention, the left handrail 23L forms a left side portion of the frame assembly 20, and the right handrail 23R forms a right side portion of the frame assembly 20. The distance between the left and right side portions roughly corresponds to the width of a user's movement space.

In this embodiment, both the left handrail 23L and the right handrail 23R extend along the front-to-rear direction of the treadmill 10 (corresponding to the longitudinal direction of the belt 31), with a length of approximately 50 cm. The rear ends of the left handrail 23L and the right handrail 23R roughly correspond to a middle position between the front and rear ends of the belt 31. The rectangular cuboid space above the belt 31 can be defined as the movement space of the treadmill 10. When a user is preparing or performing in running exercise on the deck 30, the body is usually located slightly forward of the center of the movement space (a body reference position as conceived or defined in the design). Therefore, relatively speaking, the left handrail 23L and the right handrail 23R seem to extend forward respectively from positions on the left and right sides of the user's waist, allowing the user to reach out and grip the handrails with both hands.

Figure 2:
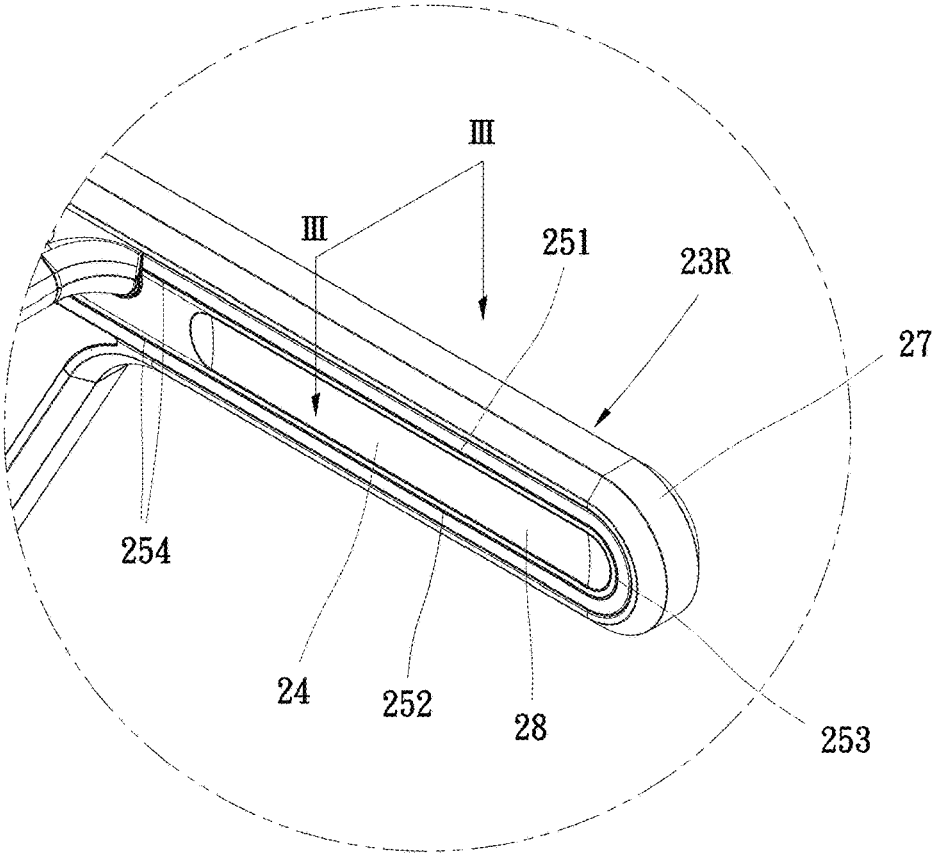
FIG. 2 is an enlarged view of the right handrail of the treadmill in FIG. 1.
Figure 3:
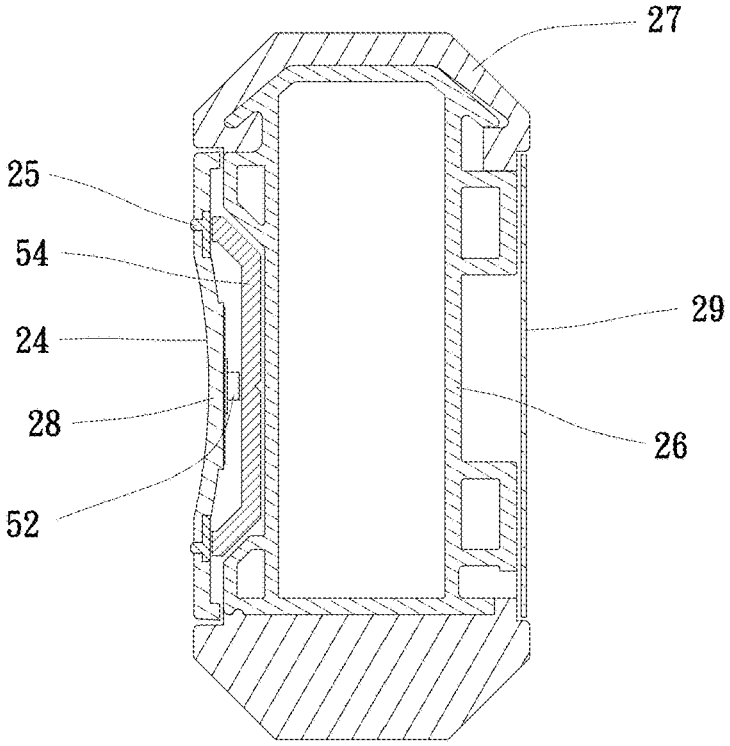
FIG. 3 is a sectional view along line II-II of FIG. 2.

Please refer to FIGS. 2 and 3 (note: the structure of the right handrail 23L shown in FIGS. 2 and 3 is symmetrical to the structure of the left handrail 23R). In terms of detailed structure, each of the left handrail 23L and the right handrail 23R has an aluminum extrusion frame 26 extending along the longitudinal direction, a plastic covering 27 that wraps around the top, bottom, and rear end of the frame 26, an inner side panel 28 fitted inside the frame 26, and an outer side panel 29 fitted outside the frame 26. The surface of the inner side panel 28 facing away from the frame 26 forms the inner side surface 24 of the left handrail 23L/the right handrail 23R. In other words, the left handrail 23L has an inner side surface 24 facing towards the right side portion and the right handrail 23R has an inner side surface 24 facing towards the left side portion. From the sectional view in FIG. 3, each inner side surface 24 is a generally vertical strip-shaped plane relative to the ground (note: actually slightly concave locally, disregarded here as flat), with a lateral length of approximately 50 cm and a vertical width of about 10 cm. The two inner side surfaces 24 are parallel to each other, spaced approximately 75 cm apart. It is noteworthy that the distance between the outer side surface (i.e., left side surface) of the left handrail 23L and the outer side surface (i.e., right side surface) of the right handrail 23R forms the maximum width of the treadmill 10, approximately 86 cm.

Each inner side panel 28 is equipped with a light guide strip 25 that allows light to pass through from the inside to the outside and emits light evenly. The light guide strip 25 is exposed on the surface of the inner side panel 28 (i.e., the inner side surface 24), covering nearly the entire perimeter length of the inner side surface 24. It includes an upper crossbar 251 and a lower crossbar 252, both of which extend along the longitudinal direction. The upper crossbar 251 and lower crossbar 252 are located in the upper and lower half of the inner side surface 24, respectively. The rear end 253 of the light guide strip 25 is adjacent to a rear edge of the inner side surface 24, forming a semicircle with a forward-facing opening that matches the shape of the rear edge. The upper crossbar 251 and crossbar 252 extend forward in parallel from the upper and lower ends of the semicircle, respectively, creating two separate front ends 254 of the light guide strip 25. A length from the rear end 253 to the front end 254 is preferably greater than 30 cm, and in this embodiment, it is over 45 cm. The portion of each light guide strip 25 exposed inside the inner side panel 28 corresponds to the shape exposed on the surface of the inner side panel 28.

Each inner side panel 28 is equipped internally with a number of light-emitting components 52 arranged equidistantly along the longitudinal direction between the upper crossbar 251 and the lower crossbar 252 of the light guide strip 25. This embodiment uses "RGB LEDs," encapsulated with red, green, and blue light-emitting diodes (commercial electronic components), which are capable of changing their emission color based on control signals. These LEDs can also generate colors beyond red, green, and blue through the additive color-mixing principle. A light guide plate 54 covers each light-emitting component 52 and connects the light guide strip 25, which is positioned between the inner side panel 28 and the frame 26. This configuration enables light emitted by the light-emitting component 52 to be transmitted through the light guide plate 54 to the light guide strip 25. Consequently, the portion of the light guide strip 25 exposed on the surface of the inner side panel 29 emits light evenly. The exposed portion of the light guide strip 25 on the inner side panel 28 of the left handrail 23L forms a left light-emitting portion on the inner side surface 24 of the left handrail 23L. Similarly, the exposed portion of the light guide strip 25 on the inner side panel 28 of the right handrail 23R forms a right light-emitting portion on the inner side surface 24 of the right handrail 23R. These left and right light-emitting portions are opposite to each other. In other embodiments of the present invention, light-emitting components may be placed internally in the left and right side portions, with glass windows or perforations set on the inner side surface to allow direct transmission of light without refraction, thus forming the light-emitting portions. Alternatively, light-emitting components may be directly placed on the inner side surface to constitute the light-emitting portions. The light-emitting portions referred to in the present invention may be a continuous area or may consist of discontinuous multiple areas (such as intermittently distributed light guide strips, light-transmitting holes, LEDs, or bulbs).

The control unit is electrically connected to the light-emitting components 52, which enables control of the light emission state of the left and right light-emitting portions. For example, this includes changing the light-emitting color, brightness, illuminated area (in this case, by controlling the number of illuminated LEDs), and/or the on-off frequencies of each light-emitting portion. Furthermore, the control unit is operable to control the light-emitting components 52 based on the operational status of the motion mechanism of the treadmill 10 (represented by the belt 31). This ensures that when the motion mechanism is in a first state, both the left light-emitting portion and right light-emitting portion display a first light-emitting state, and when the motion mechanism is in a second state, both the left light-emitting portion and right light-emitting portion display a second light-emitting state. Additionally, there may be a third or more light-emitting states, each correspond to a third or more states. The differences between these different light-emitting states are characterized by variations in light-emitting color, brightness, illuminated area, one emitting continuously while the other remains non-emissive, one emitting continuously while the other emits intermittently, one remaining non-emissive while the other emits intermittently, or both emitting intermittently but with different on-off frequencies.

For example, in a typical application similar to prior art, the treadmill 10 includes a detection device (not shown in the figure) electrically connected to the control unit. The detection device is configured to detect a movement speed of a specific component (such as motor, pulley, or drum) connected to the belt 31. Based on signals obtained from the detection device, which measures the movement speed (in this embodiment, the rotational speed), the control unit can determine whether the operational status of the belt 31 is in a first state or a second state, setting the first state as stopped and the second state as rotating. When the belt 31 is stopped, both the left and right light-emitting portions display a first light-emitting state in green. When the belt 31 is rotating, both the left and right light-emitting portions display a second light-emitting state in red. Furthermore, when the exercise program is in progress and nearing its finish (e.g., remaining time for running exercise is less than 5 minutes), both the left and right light-emitting portions display a third light-emitting state in yellow. To achieve this, the control unit first determines a predetermined time length of the exercise program (specified by the user via the input devices). When the user instructs the exercise equipment to start the running exercise, the exercise program measures an elapsed time after receiving an instruction to start the running exercise from the input devices. It then determines whether the belt 31 is in the third light-emitting state based on the elapsed time.

Alternatively, the control unit can define different states for belt 31 based on the execution status or phase of the exercise program, and make each light-emitting portion display a different color corresponding to each state. For example, during the standby state when waiting for user activation, it displays a light-emitting state in light blue. During user selection of exercise programs or setting parameter before pressing the start button, it displays a light-emitting state in yellow. When the user presses the start button and during the final three seconds of countdown, it displays a light-emitting state in white. Form the start of the program execution and throughout its duration, it displays a light-emitting state in green. When the user presses the pause button and the input device receives an instruction to pause the running exercise, it displays a light-emitting state in deep blue. When the user presses the stop button and the input device receives an instruction to stop the running exercise or the program execution ends, it displays a light-emitting state in red; and so on.

Figure 4:
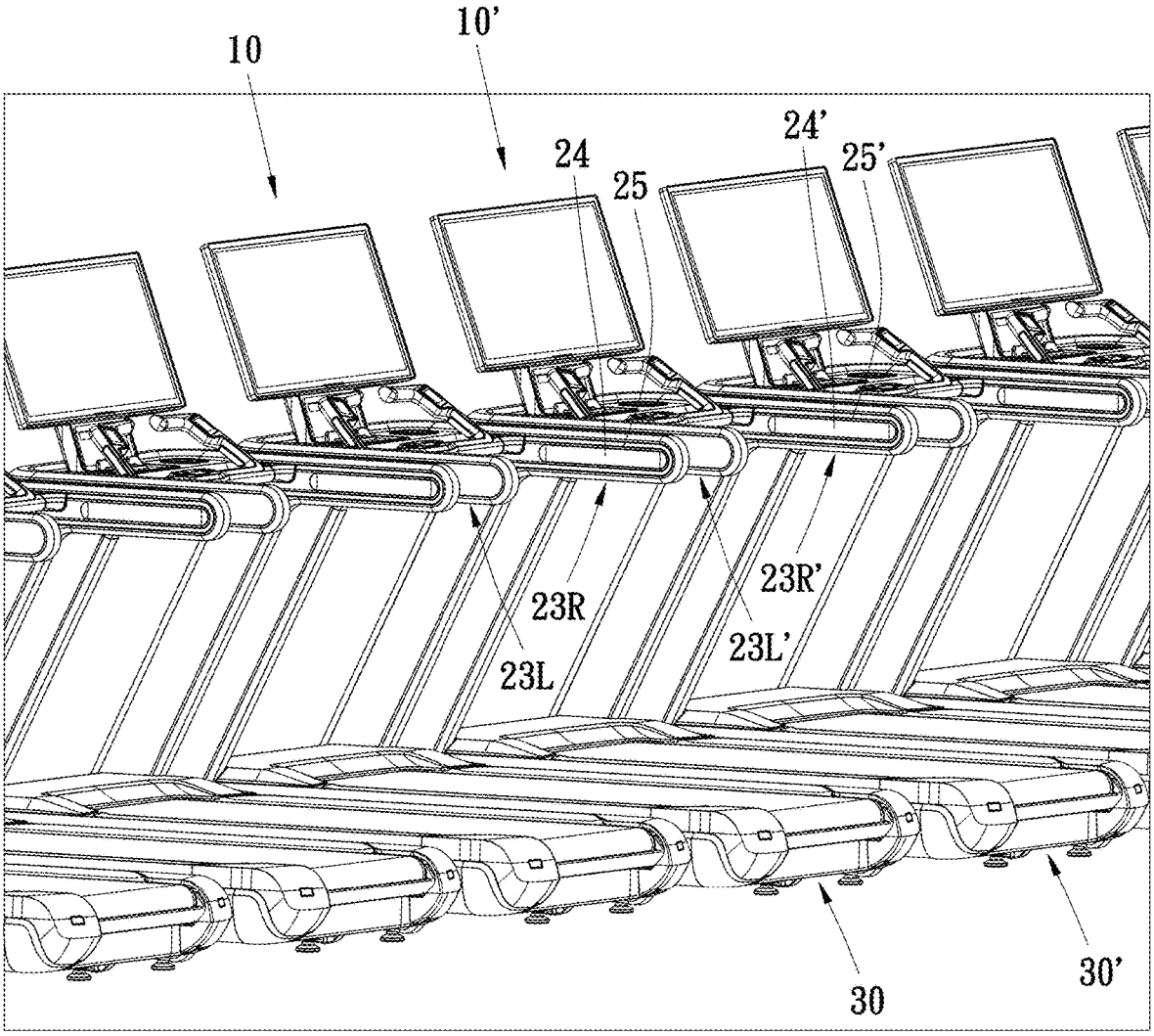
FIG. 4 shows the configuration of multiple treadmills arranged side by side in a row.

Thus, people located on the right side (including rear right side) and left side (including rear left side) of the treadmill 10 can see the left light-emitting portion and the right light-emitting portion, respectively. They can determine the operational status based on its light-emitting states, thereby identifying the usage status of the treadmill 10. As illustrated in FIG. 4, in places such as fitness clubs or community sport centers, if multiple treadmills 10 are arranged side by side in a row, the space between the inner side surfaces 24 of the left handrail 23L and right handrail 23R (approximately 75 cm in this example) is maintained sufficiently, regardless of whether the adjacent treadmills 10 are spaced wide or narrow (typically not exceeding half the width of treadmill 10). This allows people on the left and the right sides of treadmill 10 to see the light guide strip 25 (i.e., light-emitting portion) on one of the inner side surfaces 24 from a relatively wide viewing angle, enabling them to easily see the illuminated signals displayed by the light-emitting portion from various angles and at a considerable distance. As shown in FIG. 4, when observed to the right side from the aisle behind this row of treadmills, people can see the light guide strips 25 on the inner side surfaces 24 of right handrail 23R of each treadmill 10. Even if there are users on the deck 30 of treadmill 10, due to the sufficient length of the light-emitting portions extending along the longitudinal direction, in most cases, parts of the front or rear end can still be seen. In FIG. 4, only partial components are labeled for the adjacent two treadmills; for distinction, the same part on the treadmill slightly to the right is marked with the same number, with an apostrophe added. For example, if the part is labeled 10 on the left treadmill, the corresponding part on the right treadmill is labeled 10'.

Figure 5:
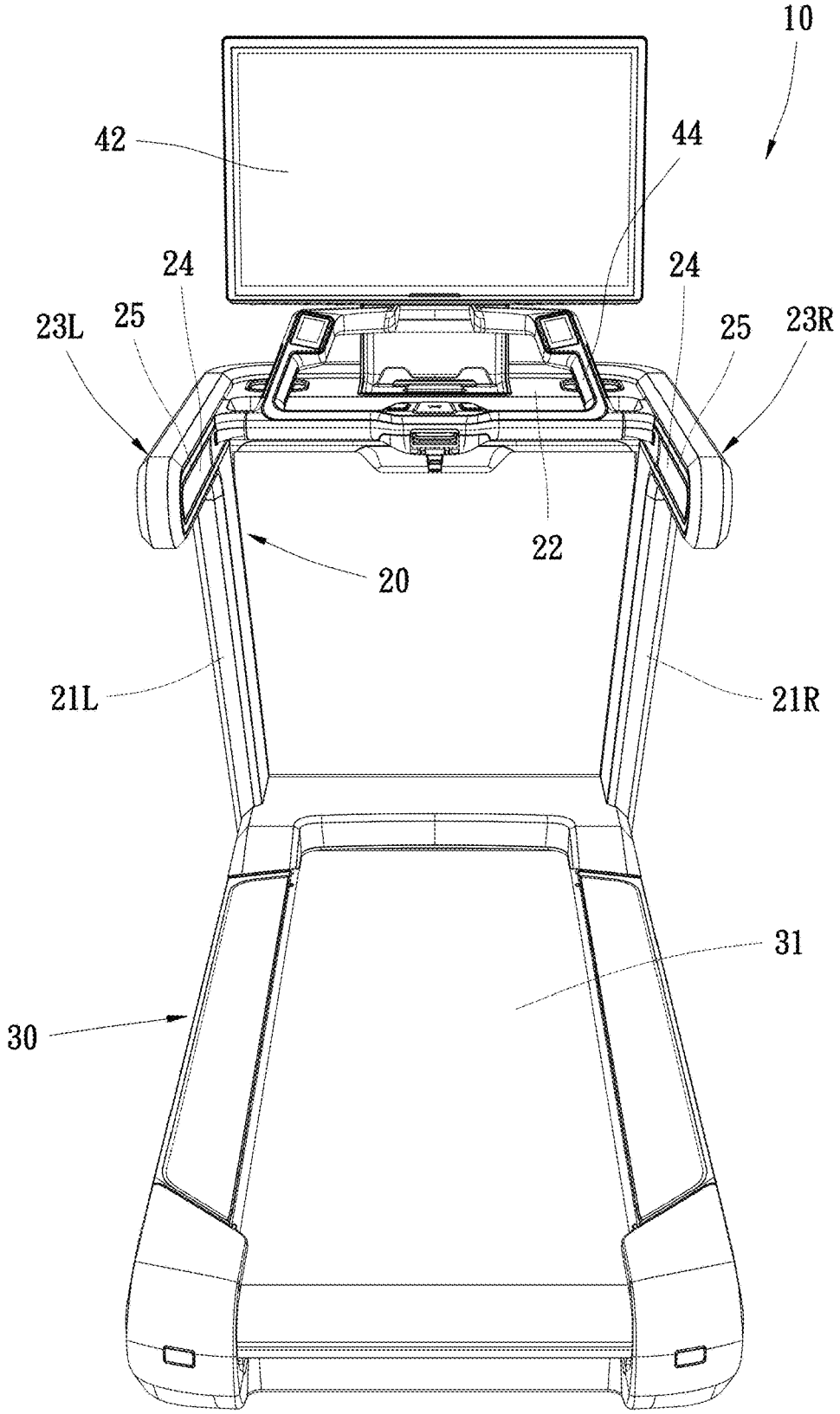
FIG. 5 is a rear elevation view of the treadmill in FIG. 1.

As shown in FIG. 5, when an observer looks forward from directly behind treadmill 10, or when a user steps onto the deck 30 from behind the treadmill 10, or exits from the deck 30 to behind the treadmill 10, they can simultaneously see the light guide strips 25 (i.e., the left light-emitting portion and the right light-emitting portion) on the inner side surfaces 24 of the left handrail 23L and right handrail 23R.

Furthermore, when a user is preparing or performing running exercise on the deck 30, the body is typically located slightly forward of the center of the belt 31 (the body reference position). The front ends of the left light-emitting portion and the right light-emitting portion are both located ahead of the body reference position, for instance, the front ends are both located at least 15 cm ahead of the middle position between the front and rear ends of the belt 31 (approximately 30 cm in this embodiment). Therefore, users who are preparing or performing running exercise can also see the left and the right light-emitting portion with their peripheral vision, enhancing feedback and safety of usage.

Based on the implementation choice, if the light-emitting portions display different light-emitting states such as deep blue and red when the user instructs the exercise equipment to pause or stop the running exercise, people at a distance from the treadmill 10 can discern whether the user intends to continue or is preparing to finish. This aids in deciding whether to find another machine or wait for a while.

Figure 6:
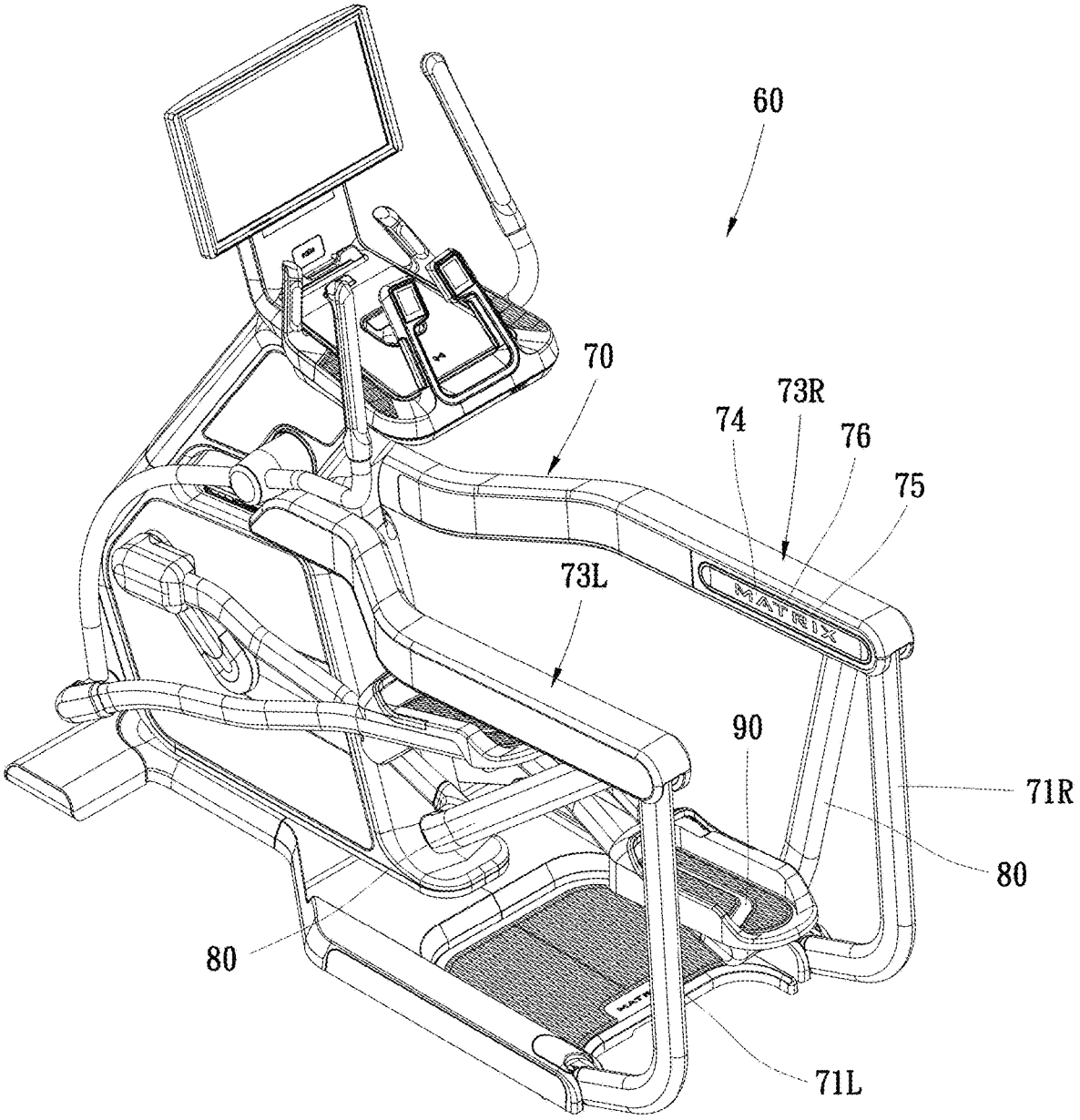
FIG. 6 is a perspective view of an exercise equipment (elliptical trainer) in accordance with a second preferred embodiment of the present invention.

Please refer to FIG. 6 for the final example. The exercise equipment in the second preferred embodiment of the present invention is an elliptical trainer 60. The detailed structure and operation of the elliptical trainer 60 can be found in the CN patent number CN 102188790 B, and will not be further elaborated here. Below is a brief description of relevant components for this application.

The elliptical trainer 60 comprises a frame assembly 70 includes a left upright 71L and a right upright 71R located at the rear end of the machine, and a left side portion 73L and a right side portion 73R extending forward from the top end of the left upright 71L and right upright 71R, respectively. The left side portion 73L and right side portion 73R are respectively positioned on the left side and right side of the user performing elliptical exercise, with each rear end supporting an arm 80. The bottom of the arm 80 indirectly guides a pedal 90, which is stepped on by the user and is operable to form a cyclical movement trajectory. In the second preferred embodiment, the motion mechanism is represented by the pedal 90. The rear halves of the left side portion 73L and right side portion 73R are positioned at an appropriate height. This allows users to grip the top rear ends of the left side portion 73L and the right side portion 73R when stepping onto the pedals 90 from behind the elliptical trainer 60, or when stepping backward from the pedals 90 to exit behind the elliptical trainer 60.

Left side portion 73L has an inner side surface 74 facing towards the right, and right side portion 73R has an inner side surface 74 facing towards the left, with the two inner side surfaces 74 parallel to each other. Each inner side surface 74 is equipped with a light-emitting portion 75. In this embodiment, the light-emitting portion 75 comprises two parallel lines and two semicircles, with the front ends of these parallel lines connected by one semicircle, and the rear ends of these parallel lines connected by the other semicircle, operating on the same light-emitting principles as previously described and thus not reiterated here. The rear ends of each light-emitting portion 75 are adjacent to a rear edge of the inner side surface 74. The length from the rear end to the front exceeds 30 cm. At the same time, a top edge of each light-emitting portion 75 is located in an upper half of the inner side surface (note: the top edge is similar to the upper crossbar 251 of the first preferred embodiment), making it easy for people to see the illuminated signals displayed by the front light-emitting portions 75 from various angles and at a considerable distance. Furthermore, each inner side surface 74 of the left side portion 73L and right side portion 73R features a trademark logo 76 surrounded by the light-emitting portions 75, enhancing the design aesthetics and brand visibility of the exercise equipment.

It should be noted that the above embodiments are only used to illustrate the technical solutions of the present invention, rather than limiting it. Although detailed descriptions of the present invention have been provided with reference to the embodiments, those skilled in the art should understand that modifications can still be made to the technical solutions described in the aforementioned embodiments, or equivalent substitutions can be made to some technical features thereof. Such modifications or substitutions do not depart from the essence of the technical solutions of the various embodiments of the present invention or the scope of patent protection thereof.

The invention claimed is:

1. An exercise equipment, comprising:

a frame assembly including a left side portion and a right side portion, the left side portion having an inner side surface facing towards the right side portion, the right side portion having an inner side surface facing towards the left side portion, the inner side surface of the left side portion and the inner side surface of the right side portion respectively equipped with a left light-emitting portion and a right light-emitting portion, each light-emitting portion is capable of emitting visible light through at least one light-emitting component;

a motion mechanism movably mounted on the frame assembly for a user to perform a specific exercise, wherein the left side portion and the right side portion are respectively located on the left side and the right side of the user performing the specific exercise, which makes them suitable for gripping by the user; and a control unit capable of monitoring the operational status of the motion mechanism, and electrically connected to the light-emitting component;

wherein the control unit is operable to control the light-emitting component based on the operational status of the motion mechanism, such that when the motion mechanism is in a first state, both the left light-emitting portion and the right light-emitting portion display a first light-emitting state, and when the motion mechanism is in a second state, both the left light-emitting portion and the right light-emitting portion display a second light-emitting state.

2. The exercise equipment as claimed in claim 1, wherein the left light-emitting portion and the right light-emitting portion each has a rear end and a front end, and a length from the rear end to the front end is greater than 30 cm.

3. The exercise equipment as claimed in claim 2, wherein the rear end of the left light-emitting portion is adjacent to a rear edge of the inner side surface of the left side portion, and the rear end of the right light-emitting portion is adjacent to a rear edge of the inner side surface of the right side portion.

4. The exercise equipment as claimed in claim 2, wherein the exercise equipment defines a body reference position within a movement space for the user to perform the specific exercise, and the front ends of the left light-emitting portion and the right light-emitting portion are both located ahead of the body reference position.

5. The exercise equipment as claimed in claim 2, wherein the exercise equipment is a treadmill, the motion mechanism comprising a treadmill belt operable for continuous rotation, wherein the front ends of the left light-emitting portion and the right light-emitting portion are both located at least 15 cm ahead of a middle position between the front and rear ends of the treadmill belt.

6. The exercise equipment as claimed in claim 2, wherein the rear ends of the left light-emitting portion and the right light-emitting portion each form a semicircle with a forward-facing opening, extending forward in parallel from upper and lower ends of the semicircle.

7. The exercise equipment as claimed in claim 1, wherein a top edge of the left light-emitting portion is located in an upper half of the inner side surface of the left side portion, and a top edge of the right light-emitting portion is located in an upper half of the inner side surface of the right side portion.

8. The exercise equipment as claimed in claim 1, wherein the exercise equipment includes a detection device electrically connected to the control unit, the detection device configured to detect a movement speed of a specific component connected to the motion mechanism; and wherein the control unit determines whether the motion mechanism is in the first state or the second state based on the movement speed.

9. The exercise equipment as claimed in claim 1, wherein the exercise equipment includes an input device electrically connected to the control unit, the input device allowing the user to specify a predetermined time length for performing the specific exercise and enabling the user to instruct the exercise equipment to start the specific exercise; and wherein the control unit determines whether the motion mechanism is in the first state or the second state based on an elapsed time after receiving an instruction to start the specific exercise from the input device.

10. The exercise equipment as claimed in claim 1, wherein the exercise equipment includes an input device electrically connected to the control unit, the input device allowing the user to specify a predetermined time length for performing the specific exercise and enabling the user to instruct the exercise equipment to pause or stop the specific exercise during the performance of the specific exercise; and wherein the control unit determines that the motion mechanism is in the first state when the input device receives an instruction to pause the specific exercise; and the control unit determines that the motion mechanism is in the second state when the input device receives an instruction to stop the specific exercise.

11. The exercise equipment as claimed in claim 1, wherein the difference between the first light-emitting state and the second light-emitting state is characterized by variations in light-emitting color.

12. The exercise equipment as claimed in claim 1, wherein the difference between the first light-emitting state and the second light-emitting state is characterized by variations in brightness.

13. The exercise equipment as claimed in claim 1, wherein the difference between the first light-emitting state and the second light-emitting state is characterized by variations in illuminated area.

14. The exercise equipment as claimed in claim 1, wherein the difference between the first light-emitting state and the second light-emitting state is characterized by variations in one emitting continuously while the other remains non-emissive.

15. The exercise equipment as claimed in claim 1, wherein the difference between the first light-emitting state and the second light-emitting state is characterized by variations in one emitting continuously while the other emits intermittently.

16. The exercise equipment as claimed in claim 1, wherein the difference between the first light-emitting state and the second light-emitting state is characterized by variations in one remaining non-emissive while the other emits intermittently.

17. The exercise equipment as claimed in claim 1, wherein the difference between the first light-emitting state and the second light-emitting state is characterized by both emitting intermittently but with different on-off frequencies.

18. The exercise equipment as claimed in claim 1, wherein the exercise equipment is an elliptical trainer, with the motion mechanism comprising a pedal operable to form a cyclical movement trajectory.

19. The exercise equipment as claimed in claim 1, wherein The left light-emitting portion and the right light-emitting portion each comprise two parallel lines and two semicircles, with the front ends of these parallel lines connected by one semicircle, and the rear ends of these parallel lines connected by the other semicircle.

* * * * *